United States Patent [19]

Doundoulakis

[11] Patent Number: 5,025,953

[45] Date of Patent: Jun. 25, 1991

[54] DEFORMABLE BEVERAGE CONTAINERS FOR PRESERVING CARBONATION

[76] Inventor: George J. Doundoulakis, 2498 Kayron Ln., North Bellmore, N.Y. 11710

[21] Appl. No.: 377,730

[22] Filed: Jul. 10, 1989

Related U.S. Application Data

[63] Continuation-in-part of Ser. No. 258,893, Oct. 17, 1988, abandoned.

[51] Int. Cl.[5] ..... B67D 5/06

[52] U.S. Cl. ..... 222/23; 222/103

[58] Field of Search ..... 222/23, 25, 154, 156, 222/92, 95, 103, 214, 386.5

[56] References Cited

U.S. PATENT DOCUMENTS

| | | | |
|---|---|---|---|
| 2,496,004 | 1/1950 | Geyer | 222/103 X |
| 2,534,708 | 12/1950 | Goodheart | 222/103 |
| 4,520,948 | 6/1985 | Hampel et al. | 222/103 |

FOREIGN PATENT DOCUMENTS

| | | | |
|---|---|---|---|
| 2227590 | 1/1974 | Fed. Rep. of Germany | 222/103 |
| 1314464 | 12/1963 | France | 222/214 |
| 1354252 | 12/1964 | France | 222/103 |
| 1597955 | 9/1981 | United Kingdom | 222/103 |

*Primary Examiner*—Michael S. Huppert
*Assistant Examiner*—Kenneth Bomberg

[57] ABSTRACT

The invention relates to deformable beverage containers for minimizing empty space in the container, to which $CO_2$ can escape, and for increasing pressure in the container for stopping evaporation of $CO_2$ from the beverage. With the container cap off or loose, the deformable portion of the container is compressed until the beverage reaches the top of the container. The cap is then secured and further compression applied until a desired pressure is reached. One embodiment covers regular bottles with a special bottle cap, comprising a check valve connected to inflatable bladder, and valve/spout arrangement for dispensing the beverage without opening the bottle. Another embodiment covers special internally deformable containers to which the beverage is transferred for preservation. A third embodiment covers plastic bottles with an external compressing mechanism for deforming the bottle and increasing pressure for maintaining the beverage during further storage.

4 Claims, 7 Drawing Sheets

DEFORMABLE BEVERAGE CONTAINERS FOR PRESERVING CARBONATION

This is a continuation in part (CIP) to a parent application titled "*Pressurizing Dispensers for Preserving Carbonation in Beverages*", under Ser. No. 07/258,893, filed 10/17/1988 now abandoned, Group Art Unit 311, Preliminary Class 222.

The invention relates to pressure maintaining means in containers of carbonated beverages, for preventing or reducing loss of $CO_2$ from the beverage remaining in its container, as the beverage is being consumed.

BACKGROUND ART

The Background art and a mathematical justification for the maintenance of pressure in saving carbonation has been presented in said parent application. Further experimentation by the inventor on this subject since the filing of said parent application has provided new information, as follows:

(1) When the beverage is pressurized by the introduction of air which comes in contact with the beverage in the container, as the pressure is increased to the optimum pressure of about 3 atm. abs. for stopping the $CO_2$ bubbles from forming, the air can defuse into the beverage, mixing with the $CO_2$ gas.

(2) CO2 gas can also be lost from the beverage as a result of turbulence generated when the beverage is being dispensed under pressure. While such a loss of $CO_2$ may not become obvious when the beverage is overcharged with CO2, it can become detrimental to the taste of the drink when the beverage contains only a marginal $CO_2$ charge.

(3) The methods found most effective in preserving carbonation in beverages are:

(a) allowing minimum empty volume in the container above the liquid to which the $CO_2$ gas can escape from the body of the beverage, while the pressure in the two regions, (beverage and empty space above the beverage) equalizes;

(b) maintaining the beverage under pressure of about 3 atm. abs. without introducing air in direct contact with the beverage; and (c) dispensing with least amount of agitation.

DISCLOSURE OF INVENTION

In accordance with the above findings, this CIP provides for further examination of the essential means for optimizing the preservation of $CO_2$ in carbonated beverages. Emphasis, thereby, is given to two of the features presented in the second embodiment (Embodiment B) of the parent application: (1) adjusting the level of the beverage to near the top of the container before securing cover, so that least amount of empty space remains above the liquid (2) providing for a mechanical advantage means for further compressing the beverage, after cover has been tightly secured, to optimum pressure but without introducing air in the container in direct contact with the beverage.

This CIP covers three embodiments, A, B, and C. According to Embodiment A the beverage is left in its own bottle, of which the cap is replaced (as is the case in Embodiment A of the parent application) by a special cap, comprising a check valve means for pressurizing the beverage, and valve/spout means operable to allow the beverage to be dispensed under the influence of the internal pressure. However, in addition, the cap in the present Embodiment A also provides a tube, connecting the check valve at the cap to inflatable means (bladder), attached at the end of the tube. The beverage then can be pressurized by pumping air into the bladder, without the air coming in contact with the beverage. The potential energy stored in terms of pressure in the bladder also acts on the beverage to force it through the spout/-valve means for dispensing; the internal pressure can then be restored by further pumping air into the bladder.

Embodiment B in the CIP is identical to the Embodiment B of the parent application, providing for a special beverage container to which the beverage is transferred upon opening of its own container. The special container is operable to deformation of its internal volume for eliminating the empty volume created as the beverage is being dispensed and for applying the desired pressure on the surface of the remaining beverage. This CIP now adds two new species to Embodiment B. The new species are simpler than the species presented in the parent application so that they can be manufactured at a lower expense and they provide a stronger and more reliable means for further adjusting the desired pressure inside the container.

Embodiment C provides means for deforming a beverage's own plastic bottle inwardly with the cover off or loose until the level of the beverage comes to the top of the bottle; the cap is then tightly secured. The simplest such means may be two surfaces (two plates of wood, plastic, or sheet-metal) acting as the jaws of a vice to squeeze the bottle. The internal volume is being reduced as the plastic bottle becomes flatter. As the bottle remains effectively uncovered during the first squeezing operation, the force needed for deforming the thin plastic wall is minimal and can be provided by hand. Latching means are provided to maintain the jaw plates at their final position against the reaction force exerted by the internal $CO_2$ pressure, about 3 atm. abs.

After the first squeezing, the loss of $CO_2$ from the body of the beverage to the small empty volume left at the top of the bottle is small; however, the internal gas pressure may cause the wall of the bottle that is not in contact with the compressing surfaces to deform outwardly, causing an increase in the size of the empty volume, and, therefore, the amount of $CO_2$ lost from the beverage. To prevent such a loss, following the capping of the bottle, Embodiment C provides additional species comprising mechanical advantage means for further squeezing the bottle and therefore increasing the internal pressure up to the beverage internal gas pressure.

Accordingly, it is the main object of the CIP to this invention to reduce loss of $CO_2$ gas from beverages by maintaining a proper pressure inside the container as the beverage is being dispensed, through compression of a deformable wall of the container.

It is a further object of this invention to provide a bottle cap with appropriate thread, as shown in FIG. 1, for replacing the standard cap in conventional beverage bottles as soon as they are opened; such cap further comprising a gas intake port with a check valve to allow a one way gas flow to bladder means at end of tube near the bottom of the bottle, for maintaining a proper pressure in the beverage bottle, and a beverage output port on to which are connected valve means for allowing or stopping the flow of beverage.

It is another object of this invention to provide two additional species in accordance with the Embodiment B of the parent application, according to which, upon opening a conventional beverage bottle, the beverage is to be transferred into a special container which is deformable in order to eliminate the empty volume created by dispensing beverage, and also provides means for further compressing the remaining beverage for maintaining an optimum pressure inside the container.

It is a further object of this invention to provide means for deforming conventional beverage plastic bottles with the cap off or loose until the level of the remaining beverage reaches the top of the bottle at which time the cap of the bottle is being secured and the position of the deforming means is latched, for eliminating a large volume at the top of the bottle to which the $CO_2$ gas can escape from the beverage.

Still another object of this invention is to provide the means for beverages such as beer, champagne Coca-Cola, 7-Up, etc., packaged in containers other than conventional plastic bottles, such as cans and glass bottles, to be transferred, upon opening of their cover, to an empty conventional beverage bottle properly capped according to Embodiment A, to a deformable bottle according to Embodiment B, or to a plastic bottle which can be deformed in accordance with the Embodiment C, using the present invention in same manner as described in the case of beverages coming in conventional plastic containers.

Other objects and features of the invention will be discussed as the description of the particular physical embodiments are selected to illustrate the invention processes. The various novel features that characterize the invention are pointed out particularly in the claims annexed to and forming a part of this specification. In addition, for a better understanding of the invention, its operating advantages and specific objects attained by its use, references are made to the accompanying drawings and descriptive matter in which preferred embodiments of the invention are illustrated and described.

The invention is illustrated diagrammatically in the accompanying drawings by way of examples. The diagrams illustrate only the principles of the invention and how these principles are employed in various fields of application. It is, however to be understood that the purely diagrammatic showing does not offer a survey of other possible constructions, and a departure from the constructional features, diagrammatically illustrated, does not necessarily imply a departure from the principles of the invention. For example, each of the valves and check valves shown in the various configurations can be designed in various forms. While several types of mechanical advantage means and latching means are presented in conjunction with Embodiment C, there can be several more, not shown. It is, therefore to be understood that the invention is capable of numerous modifications and variations to those skilled in the art without departing from the spirit and scope of the invention.

In the accompanying drawings, forming part hereof, similar reference characters designate corresponding parts in both the CIP and the parent application.

BRIEF DESCRIPTION OF DRAWINGS

The details of my invention will be described in connection with the accompanying drawings in which.

BEST MODE FOR CARRYING OUT THE INVENTION

Embodiment A

Figure 1:
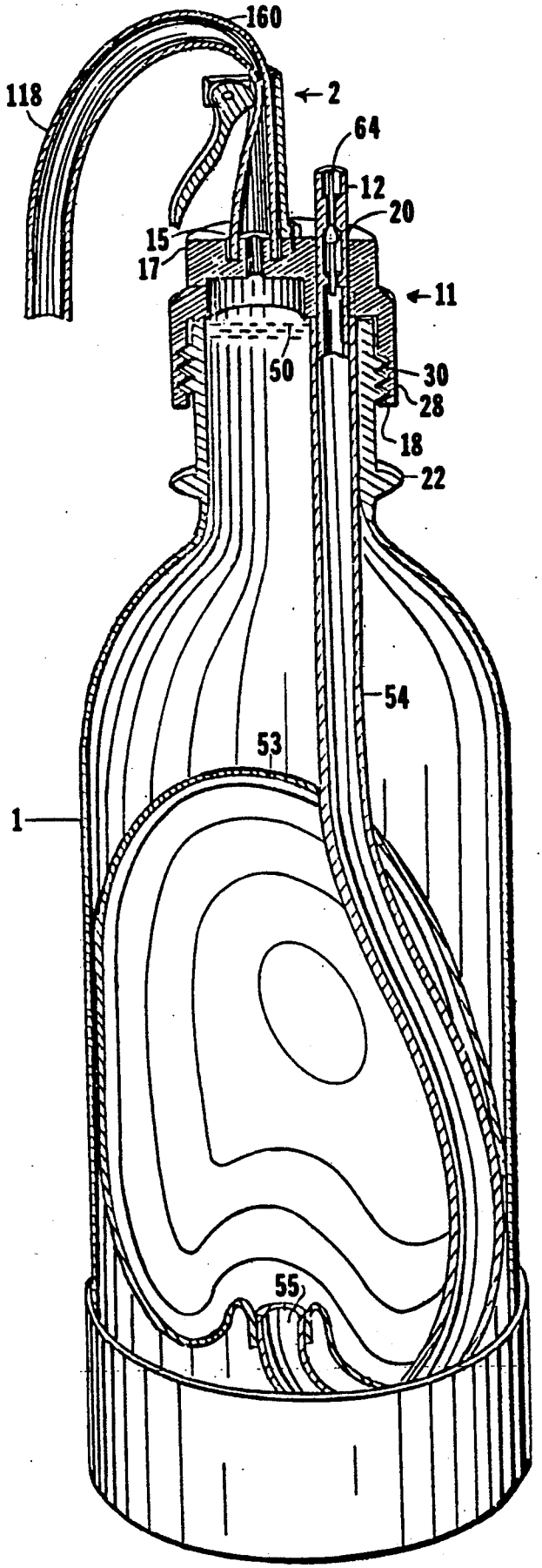
FIG. 1 is a cross-sectional, fractional, perspective elevation view showing a novel cap covering a conventional beverage bottle comprising a check valve means, inflatable means and spout/valve dispensing means in accordance with Embodiment A of the invention.

Embodiment A is here represented by a special cap 11 to replace, upon opening, the cap of a conventional beverage bottle, as shown in FIG. 1. The aim of this embodiment is to provide relatively simple means for conserving carbonation in beverages by minimizing the empty volume above the remaining beverage in the bottle and by further increasing the pressure in the beverage. Referring to FIG. 1, this embodiment comprises a cap 11, similar to that shown in FIG. 3 of the parent application, now including, in addition, inflatable means (bladder) 53, located near the bottom of the bottle 1 and supported by the cap 11 via a tube 54, which is also used to conduct air between a Schreader valve 12, built in the upper portion 17 of the cap 11 and the bladder 53. As in the parent application the upper portion 17 of the cap 11 further comprises a beverage output port 15, while its lower portion ends at a skirt 28, having in the inside thread 30 to match the standard thread 18 of a bottle 1. The output port 15 is shown outfitted with a tube 160, ending as a spout 118, for dispensing the beverage; while the flow can be adjusted through a pinch-valve 2. According to this embodiment the original cap is replaced with the new cap 11 and with the bladder being uninflated. While the cap 11 is still loose, air is pumped, by pumping means (a bicycle pump, a pumping ball, or electrified pumping means, not shown) attached to the valve 12, until the level 50 of the beverage reaches the top of the bottle 1. The cap 11 is then being tightened and additional air is being pumped into the bladder until the bubbles in the beverage disappear, indicating that the pressure in the bottle 1 is equal to the pressure of the $CO_2$ gas in the body of the beverage. It may be noted that the air pumped into the bottle 1 is being restricted within the confines of the bladder and does not come in contact with the beverage.

The pressure for dispensing the beverage through the spout 118 comes from the potential energy stored in terms of pressure in the bladder 53. The lowering of internal pressure as the beverage is being dispensed, can be corrected by pumping more air into the bladder 53. Before or after pouring the last cup of beverage, the cap 11 can be removed by first allowing the bladder 53 to contract by letting the air in the bladder to escape, by pressing the center pin 64, of the Schreader valve 12 in the same manner as for lowering the pressure in a tire.

Embodiment B

Figure 2:
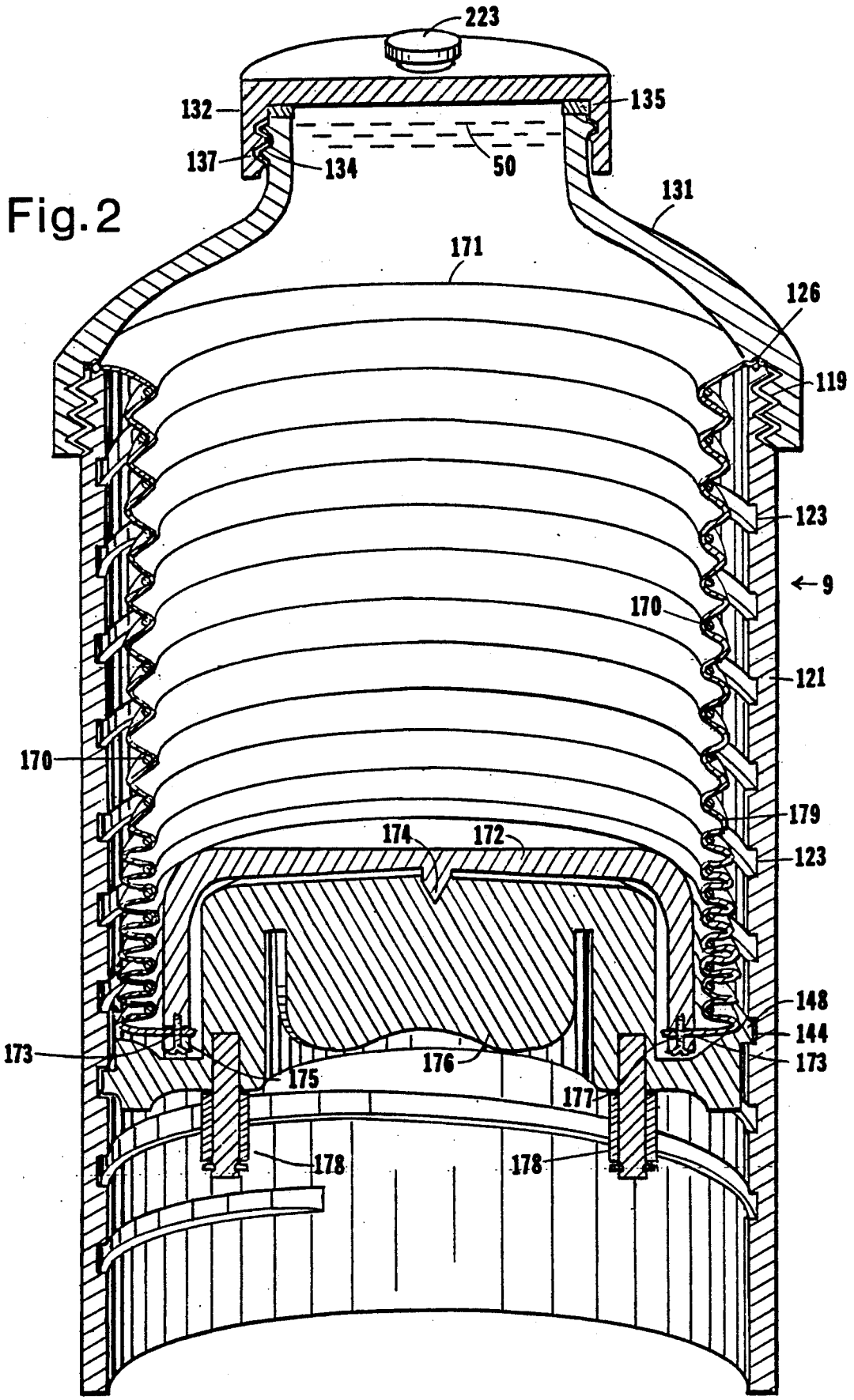
FIG. 2 is a cross-sectional perspective elevation view of a first additional species in accordance with Embodiment B of the invention, showing a beverage container which is internally deformable to eliminate the space normally created during dispensing of the beverage, and also showing means for compressing the remaining beverage, thereby, maintaining a desired pressure inside the container for preserving the carbonation in the beverage. The species shown in FIG. 2 is characterized by a thread cut on the inside wall of an external cylinder of the container, onto which a jack screw can be turned by hand through the bottom of the container to compress a bellows containing the beverage at the upper part of the container.

The first of two new species of a container 9 belonging to the Embodiment B of the invention is shown in FIG. 2. An outer cylinder 121 provides at the top end a thread 119 for mating with the upper portion (neck) 131, of the container 9. The neck 131 provides at the top a thread 134 for a cap 132, which provides a matching thread 137. A gasket 135 is interposed between the lip of the container 9 and the cap 132 to insure air tightness. A flexible bellows 171 is fitted inside the cylinder 121 of the container 9. The upper edge 126 of the bellows 171 is clamped between said parts 121 and 131. Such clamping is made secure and air-tight via the thread 119 at an "o" ring 126, which may be part of the bellows 171.

The lower edge 173 of the bellows 171 is clamped along the lower edge of a thrust cap 172. While the method shown in FIG. 2 for this clamping is using a ring 175 secured to the cap 172 by screws 177, other means of attachment such as a thread, similar to that shown for the top edge, can also be effective.

The bellows 171 is shown to comprise a plurality of convolutions 179, which can fold to reduce the internal volume of the container and thereby that of the beverage, as the piston 172 is raised inside the container. The position of the thrust cap 172 can be adjusted by tuning a jack screw 144, which provides a thread 148 matching a thread 123 cut on the internal side of the cylinder 121. The cap 172 is supported on the jack screw 144 on a conical pin 174 for impeding transfer of torque to the piston 172 as the jack screw 144 is being turned.

As the member 144 is turned clockwise by hand through the bottom of the container, the cap 172 is being displaced upwardly, while the convolutions 179 are folding around the cap 172; thereby the internal volume of the container devoted to the beverage is being diminished. As in the case of Embodiment A the cap 132 can remain off or loose until the level 50 of the beverage reaches the top of the container. At this point the cap 132 is tightly secured and additional compression is applied to the liquid by further turning of the screw 144 until the pressure indicator 223 shows that the desired pressure has been reached. The bottom of the cylinder 121 is left open so that the screw 144 can be reached and turned by hand via the wing knob 176 or via either or both spanner posts 178, where a force couple can be applied between the thumb and the forefingers of the hand.

Depending on the properties of the material of the bellows 171 non-strechable rings 170 may be added to prevent the bellows from expending radially.

FIG. 2 shows the assembly of the thrust cap 172 and jack screw 144 positioned about 30% above its lowest position in the container 9; as a consequence, some of the convolutions 179 are shown folded and settled around the cap 172.

As the walls of the container 9 may be sufficiently opaque to prevent view of the disappearance of bubbles inside the beverage, a pressure indicator button 223 is shown installed on the cap 132 for indicating when the optimum pressure has been reached.

Figure 5:
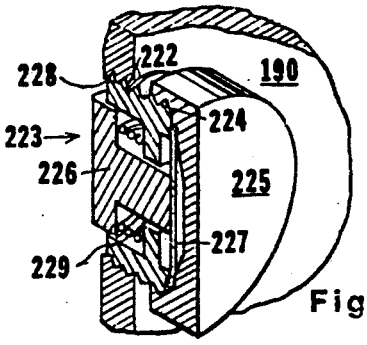
FIG. 5 is an isometric cross-sectional view of a simple indicator in the form of a button, installed on a wall for indicating when the beverage pressure on the rear side of the wall has reached a predetermined level, while the pressure on the outside remains atmospheric.

Referring now to FIG. 5, the indicator 223 is shown to comprise a nipple 222 with a thread 228 by means of which can be attached on to a round hole with corresponding thread. Such hole may be provided on a container cap or on a front plate 190 in the Embodiment C. The nipple 222 is covered by a transparent window 225 via a thread 224 which also serves to clamp a diaphragm 227 between the window 225 and nipple 222. The side of the diaphragm 227, towards the window 225, is colored with a characteristic color such as red. During assembly the space between the diaphragm 227 and the window 225 is filled with a liquid colored with another characteristic color such as green, which normally shows through the window 223 at lower than a desired pressure. A stud 226 acting as a piston is cemented on to the diaphragm 227 and is normally urged away from the diaphragm 227 by a spring 229. While in FIG. 5 the spring 229, for the purpose of clarity, is shown as a wire spring, the needed spring action may conveniently be provided by a spring washer of predetermined stiffness. As the pressure on the surface of the bottle is increased, the head of the stud 226, is being displaced as it is being urged by the beverage pressure, against the force of the spring 229, towards the diaphragm 227, which is also being displaced, and at a predetermined pressure, the diaphragm reaches and touches the inner side of the window 223, displacing the green liquid to the region along the edge of the diaphragm outside the periphery of the stud 226, while the red color of the diaphragm becomes visible through the window of the indicator 225.

Figure 3:
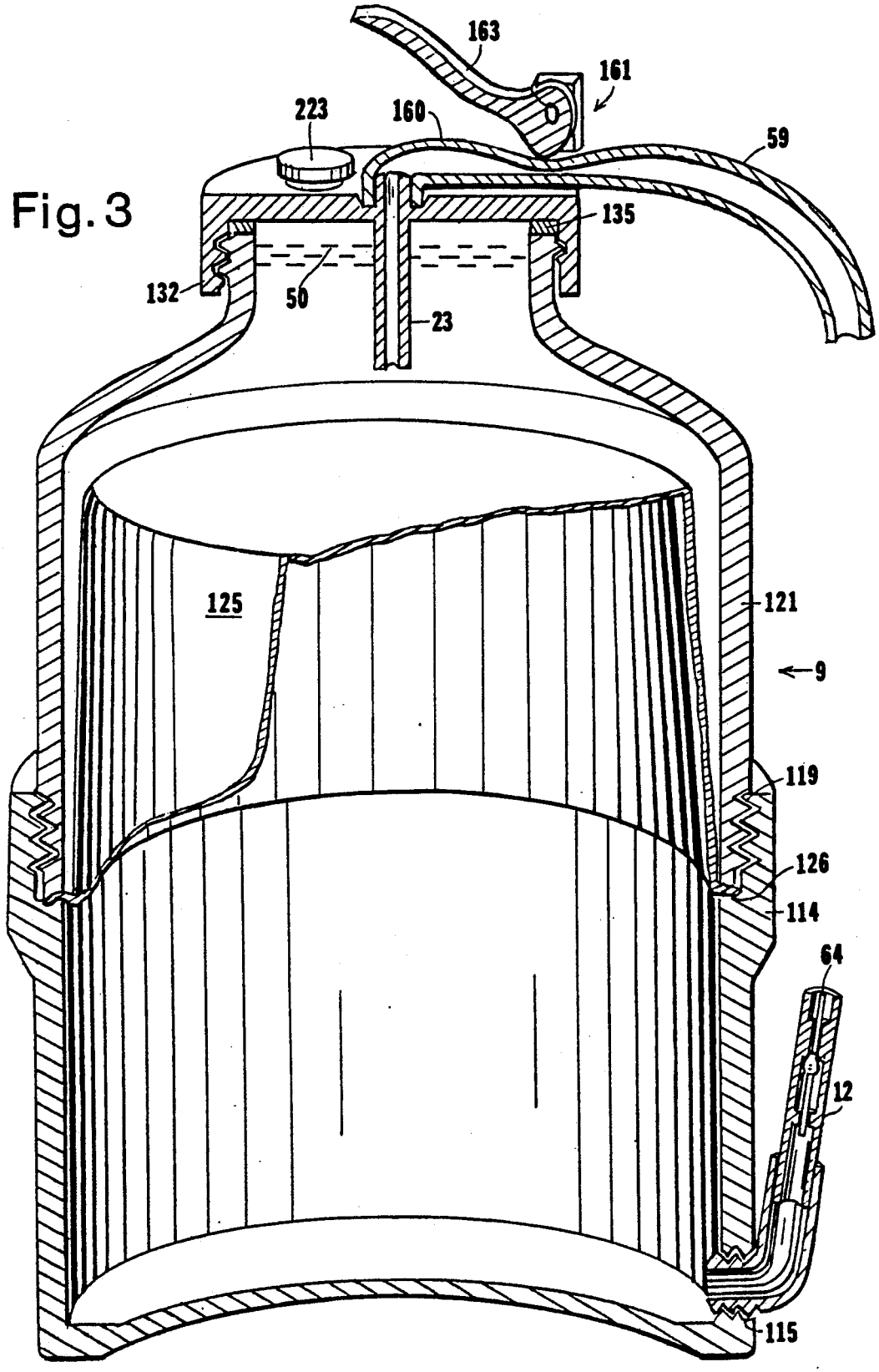
FIG. 3 is a cross-sectional perspective elevation view of a second additional species in accordance with Embodiment B of the invention, showing a beverage container which is internally deformable to eliminate the space normally created during dispensing of the beverage, and also showing means for compressing the remaining beverage, thereby, maintaining a desired pressure inside the container for further preserving the carbonation in the beverage. The species of FIG. 3 is shown to comprise a substantially cylindrical container made in two parts which are joined by a threaded section also used to clamp the edge of a bladder; a check valve in the lower section of the container for allowing air to be pumped between the bladder and the lower part of the container, forcing the bladder upwardly to raise the level of the remaining beverage in the upper part of the container; Spout/valve dispensing means are shown as integral part of the container cap.
Figure 4A:
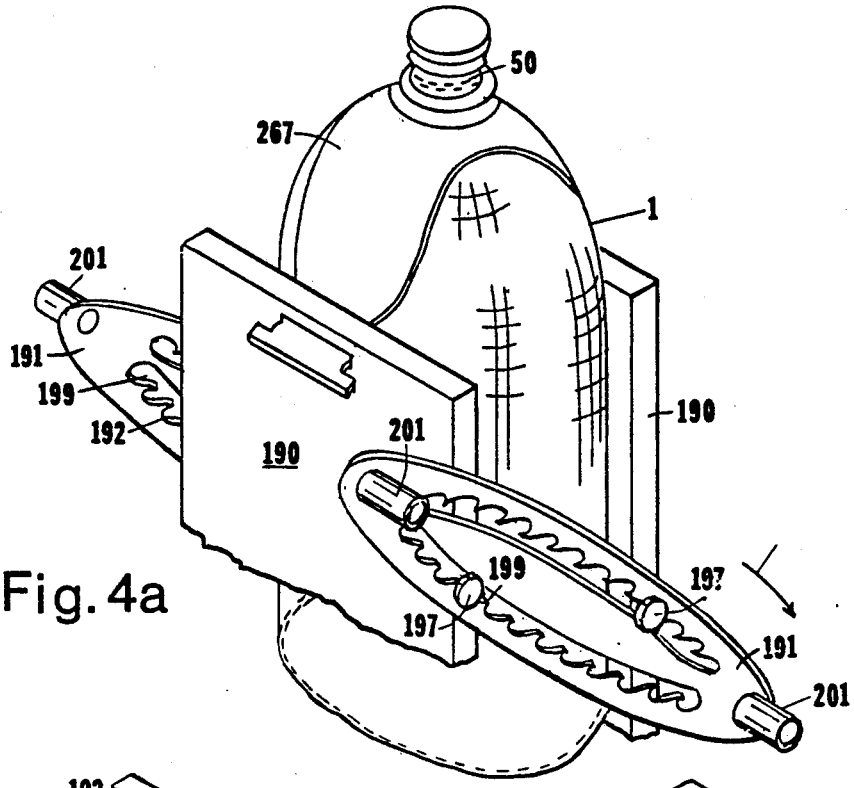
FIGS. 4(*a,b,c,d*) is an isometric fractional view showing four different types of latching means which may be adapted into species of Embodiment C in conjunction with two substantially flat surfaces (plates) used as the jaws of a vice to compress a conventional plastic bottle by hand, while the bottle remains uncovered or with the cap loose, for bringing the level of the remaining beverage to the top of the bottle. The bottle is then tightly capped, while said latching means are shown to maintain said plates at their final position.
Figure 4B:
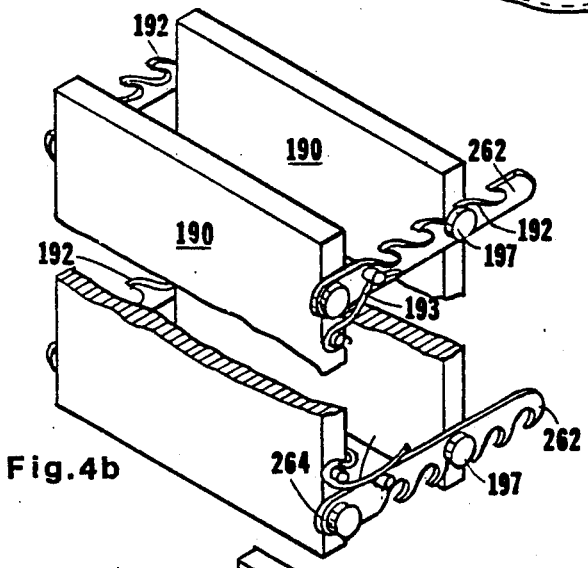
Figure 4C:
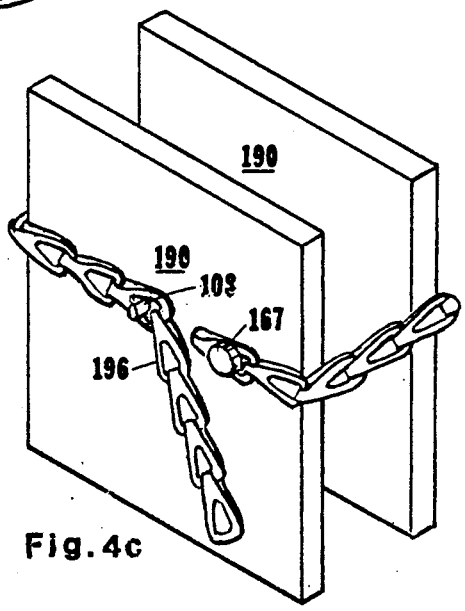
Figure 4D:
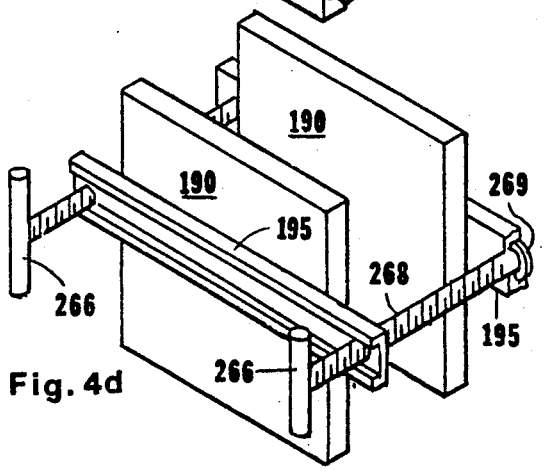

The second of the two new species belonging to the Embodiment B of the invention is shown in FIG. 3. A container 9 is made of two parts, a lower part (base) 114 and an upper part (neck) 121, which are held together by thread 119. Internally to the container 9 is fitted a flexible bladder 125, for containing the beverage between it and the neck 121. The end of the bladder 126 is clamped between the two parts 114 and 121 which can be tightened via a thread 119. For full internal volume the bladder is unfolded downwardly to the bottom of the container 9. Air pressure is introduced between the bladder 125 and the base 114 of the container 9 via a Schreader valve 12, threaded on to the base 114 via a thread 115. As the beverage is being dispensed more air is pumped inside the container 9 to force the bladder 125, upwardly.

After the beverage (soda, beer, champagne etc) is poured into the container 9, and with the cap 132 off or loose, air pressure is added via the valve 12 until the level of the beverage comes to the top of the container. The cover 132 of the container is then tightly secured, with a gasket 135 insuring air-tightness. The air pressure is subsequently increased under the bladder by pumping air to a pressure of about 3 atm. abs. A pressure indicator button 223, as described in connection with FIG. 5, can serve to indicate when the correct pressure has been reached. The desired pressure serves to prevent the $CO_2$ pressure, of same magnitude, establishing a considerable size of space filled with $CO_2$ gas at the top of the container by pushing the beverage and therefore the bladder back downwardly. A spout 59 in tandem with a pinch valve 161 are shown in FIG. 3 as part of the cap 132 for controlling the flow of the beverage being dispensed under the pressure stored inside the container. A short syphon 23 serves to prevent any $CO_2$ accumulated at the top of the container from escaping through the spout 59. For dispensing the last cup the internal pressure must be lowered to below atmospheric by pressing at the center pin 64 of the Schreader valve 12.

Embodiment C

Embodiment C is directly applicable to preserving carbonation in beverages shipped in conventional thin-walled plastic bottles. It provides means for compressing the bottle 1 between two jaw plates 190, until, with the cap off or loose, the level 50 of the beverage reaches the top of the bottle. The cup is then secured and tightened on the bottle; while the final position of the plates 190 is latched by special latching means.

FIG. 4 shows three elementary methods a, b, and c for accomplishing the latching of the jaw plates 190 at their final position. In each of these cases the beverage bottle 1 is squeezed as the jaw plates 190 are forced together by use of the hands. A bottle 1 is shown flattened to a certain extent as it is being compressed between the jaw plated 190 in FIG. 4(*a*). A bottle 1, although not shown, is also implied between the jaw plates 190 in FIGS. 4(*b*), 4(*c*), and 4(*d*).

According to the method shown in FIG. 4(*a*) the plates 190 are latched by a pair of ratchet clamps 191, of elliptical shape having slots 199 with ratchet teeth 192 disposed on one side, to allow catching pins 197, which are mounted on to the plates 190 and acting as latching pawls and retainers, to be displaced towards teeth corresponding to a closer spacing of the plates 190; but preventing reverse displacements. The spanner posts 201 at the ends of the major axis of the elliptic rings 191 serve to provide the points for applying a force couple, using the thumb and the forefingers of the hands. The posts 201, therefore, contribute a small mechanical advantage in turning the ratchets 191 in the direction of the arrow 202, for higher compression.

The method shown in FIG. 4(*b*) comprises a pair of jaw plates 190 for compressing the bottle 1; while the latching means are provided in terms of at least two, and preferably four ratchet bars 262 having on one side ratchet teeth 192 so that catching pins 197, acting as ratchet pawls, which are mounted onto the plates 190, can be displaced to new ratchet teeth as the plates 190 come closer together; but are prevented to move in the reverse direction, latching the final position of the plates 190. Wire springs 193 urge the ratchet bars 262 in the direction where the teeth 192 can be effective in engaging the pins 197.

The method shown in FIG. 4(*c*) can be implemented with even simpler latching means, comprising a pair of jaw plates 190 and a chain 196 which is permanently secured at one end on to the front plate 190 by a mounting pin 167 and then is further secured at an appropriate link at a post 198, after the plates 190 as a bottle 1 (not shown) has been squeezed, have reached the desirable proximity.

While the methods for latching in Embodiment C shown in FIGS. 4(*a*) through 4(*c*) are characterized by extreme simplicity, they have been tested to be substantially effective in reducing loss of $CO_2$ in carbonated beverages carried in plastic bottles. These methods, however, do not provide a desirable mechanical advantage in compressing the bottle. Weak hands, such as those of advanced age and of young children, may not be able to provide the require force. Further, the $CO_2$ pressure of about 3 atm. abs. in the body of the beverage can act, even after latching of the plates 190, to increase the empty volume at the top of the beverage by deforming the portion of the bottle not in contact with the wall of the bottle 1, with loss of $CO_2$ gas as a consequence. To prevent this loss of $CO_2$ mechanical advantage means are needed for further increasing the force on the bottle until it matches the internal $CO_2$ pressure, of about 3 atm. abs. The species shown in FIGS. 4(*d*), 6, 7, and 8 provide such mechanical advantage means, besides the latching means for holding the final position of the plates 190. By "mechanical advantage", it is implied: the ratio $D_1/D_2$, of the linear distance $D_1$ through which the hand moves, to produce a change $D_2$ in the distance between the plates 190.

The method shown in FIG. 4(*d*) comprises jack screws 268, which can be operated by hand through handles 266 for providing the desired force to and latching the final position of the plates 190, after a bottle (not shown), in between the plates, has been compressed to a desired extent. A "u" channel 195 is shown added to each plate 190 as a structural reinforcement. The thread on the screws 268 ends before the rear channels where bushings 269 press against the rear channels as the screws are turned counter clock-wise, forcing the two plates 190 to a closer spacing.

Figure 6:
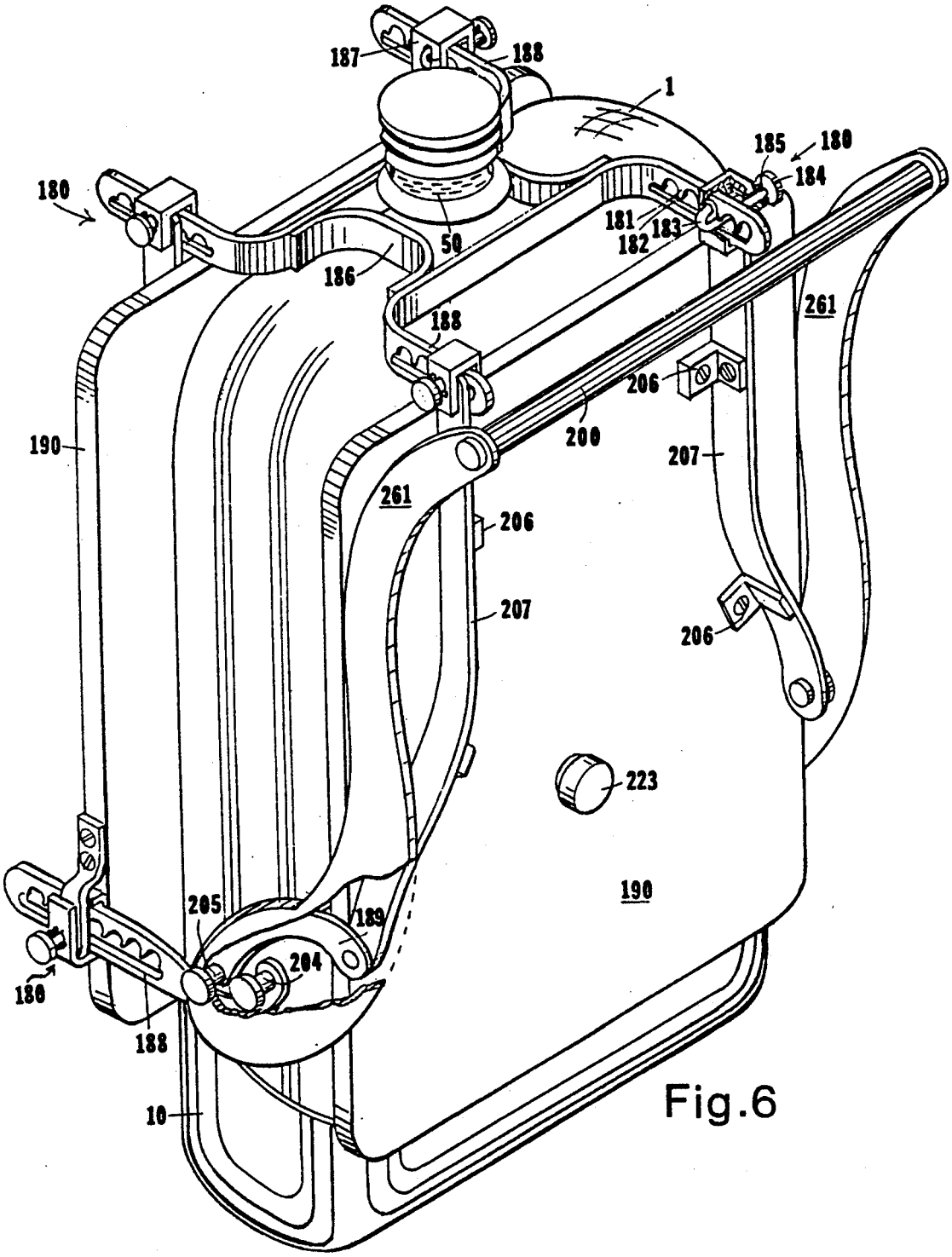
FIG. 6 is an isometric view of a first species belonging to the Embodiment C of the invention, showing two substantially flat surfaces (jaw plates) for compressing a conventional plastic bottle by hand, while the bottle remains uncovered or with the cap loose, for bringing the level of the remaining beverage to the top of the bottle, and latching means for latching the jaw plates at their final position; also showing means for adjusting the position of the jaw plates and mechanical advantage means for enabling the user to further compress the beverage after the cap of the container has been secured, for further increasing the internal pressure.

Referring now to FIG. 6, a bottle 1 is shown to be compressed between a pair of jaw plates 190. A spider structure 186 serves to position a compressing mechanism over the plastic bottle 1. The structure 186 ends at, at least, two and preferably four adjustable type latches 180, connecting the structure 186 to brackets 207. The brackets 207 are secured on to the plates 190 at points 206. The latches 180 are of a well known type characteristic of providing a reliable operation. In each latch 180 a catching pin 184 provides a hook 183 at its end. The pin 184 is urged by a spring 185 towards having the hook 183 inserted between two of a series of teeth 181 disposed next to a slot 182 along the bar 188 of the latch 180. When the pin 184, is pressed against the force of a spring 185 so that the end of the hoop protrudes outside the bar 185, the main body of the pin 184 can move along the bar 188 inside the slot 182. In fact when the end of the hoop 183 is pushed, against the force of the spring 185, clear above the surface 187 surrounding the bar 188 and rotated slightly, the pin remains hung and cannot return to its normal position, the latch remains unlocked and the pin position may be freely adjusted along the slot 180 of the bar 188.

With the top front latches adjusted at an estimated position and all four rear latches free the bottle, with its cap off or loose, can be compressed by hand until the level of the beverage reaches the top of the bottle, at which point the cap is tightly secured and the pins of the four latches are rotated back, so that their hooks are allowed to fall inside the nearest space between teeth 181, locking the latches.

During the above procedure, the handle 200, connecting a pair of lever arms 261, should have been kept downwardly, at which position a pin 205 is located to the right of the pin 204 and at a distance equal to that shown in FIG. 6 between the two pins. With the pin 204 being supported by the bar 188, (therefore at a particular distance from the rear plate 190), and the pin 205 supported by a linkage bar 189 which, in turn, is pivoted at the bracket 207 of the front plate 190, the distance of the plates 190 at the level of the pivoting pins 204 and 205, can be shortened by twice the distance of the pins by rotating the handle 200 from its lowest position to its upper position, shown in FIG. 6. The setting of the lower latches can be adjusted so that the bubbles disappear when the bottle is being further compressed through the mechanical advantage provided by the levers 261. It may be noted that at least the four latches shown at the top in FIG. 6 could be easily implemented by the type of latches shown in FIG. 4(*a*) or 4(*b*). It may also be noted that, for pouring the next cup of beverage, the bottle compressing means revealed in FIG. 6 can provide fast pressure reduction by simply lowering the handle 200.

In cases where the bottle 1 may be dark-colored so that the bubbles cannot be easily observed, an indicator 223, the construction of which has been previously explained in connection with FIG. 5, may be used to indicate when the pressure in the bottle reaches the desired pressure of about 3 atm. abs. Two such pressure indicators, one set to change its color at atmospheric pressure, the other at about 3 atm. abs., can provide all the information needed for the adjustment of the latches 180.

Figure 7:
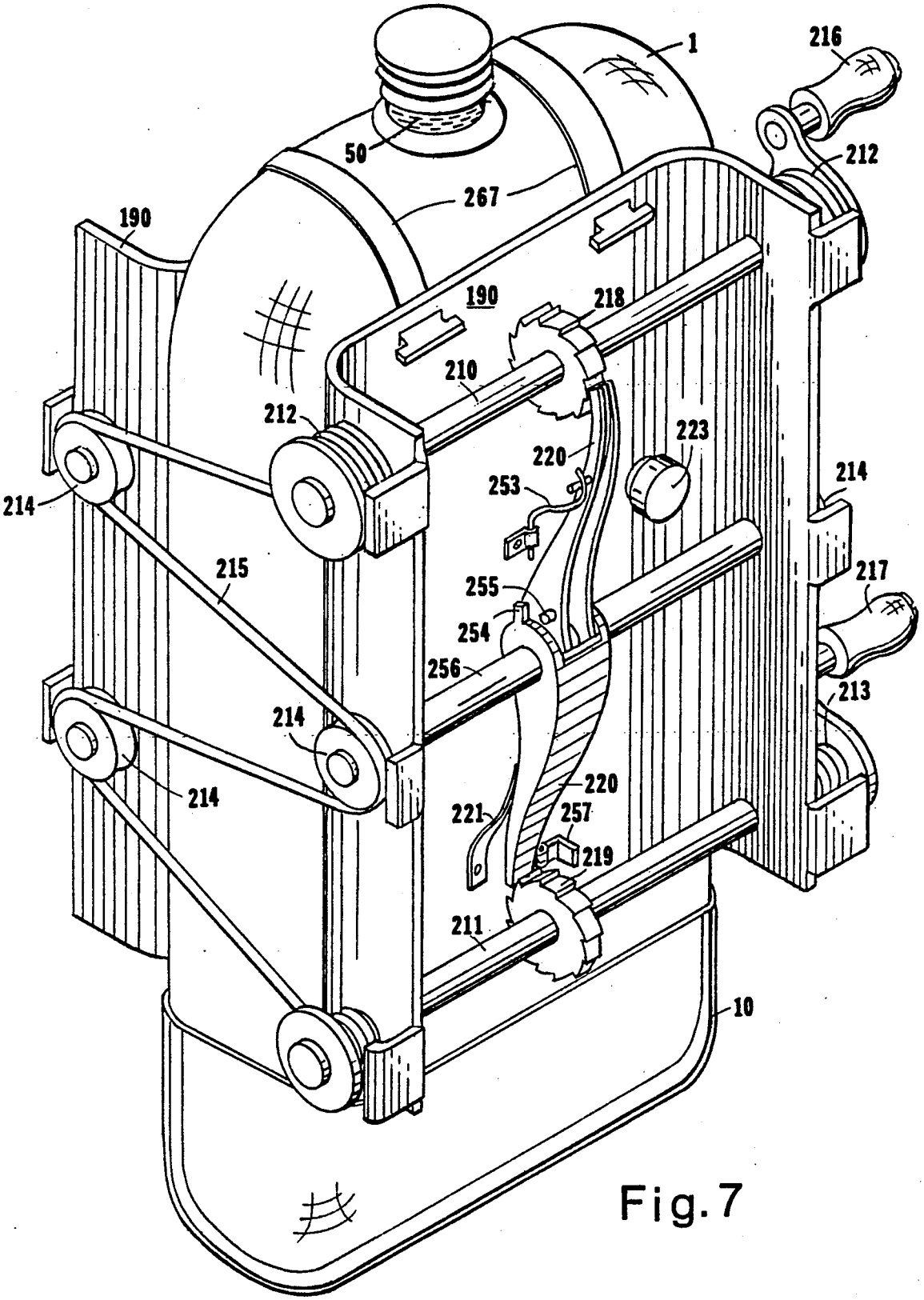
FIG. 7 is an isometric view of a second species belonging to the Embodiment C of the invention, showing two substantially flat surfaces (jaw plates) for compressing a conventional plastic bottle by hand, while the bottle remains uncovered or with the cap loose, for bringing the level of the remaining beverage to the top of the bottle, and latching means for latching the jaw plates at their final position; also showing crank and pulley means for adjusting the position of the jaw plates, such crank/pulley means also operable as mechanical advantage means for enabling the user to further compress the beverage after the cap of the container has been secured, for further increasing the internal pressure.

FIG. 7 shows another species comprising jaw plates 190, latching means 218 and 219 and mechanical advantage means provided in terms of cranks 216 and 213 and pulleys 214. A beverage plastic bottle 1 with the cap off or loose is shown being compressed between the plates 190. A crank 216 driving a shaft 210 and thereby a pair of reels 212 (one on each side) each having a diameter sufficiently large for taking up a substantial portion of the line 215, used on its side, is turned clock-wise. This brings the plates 190 closer, while compressing the bottle 1, the shape of which is shown to have changed from round to flattened. A multiplicity of pulleys 214 serve to increase the mechanical advantage as is true in the case of a tackle, whereby the force on the plates 190 is equal to the force on the line, multiplied by the number of the pulleys. The bottle compressing device shown in FIG. 6, can be operated by the weak hands of the elderly or children. When the level 50 of the beverage reaches the top of the bottle, the turning of the crank 216 is stopped and the cap is tightly secured. The final position of the plates 190 is latched at this point by the combination of ratchet 218 and ratchet pawl 222, which is being urged towards the teeth of the ratchet 218 by a wire spring 253. The crank 217, driving a shaft 211, is then used for further compression, until the bubbles inside the beverage disappear, indicating that the applied pressure matches that of $CO_2$ gas in the body of the beverage. The final position of the plates 190 is latched by the ratchet pawl 220, urged towards the ratchet 219 by a leaf spring 221. The bottle, as is compressed, is ready for refrigerator storage.

It may be noted that the reels 213 (one on each side) provide a much smaller diameter than those of the reels 212; therefore the crank 217 can provide a much greater mechanical advantage than the crank 216. Each crank provides its own mechanical advantage factor equal to the ratio of the crank radius divided by the radius of the reel it drives. For example, assuming the device in FIG. 7 provides a diameter ratio between crank 217 and reel 213 equal to 15 and having 3 pulleys 214, it will provide a $15 \times 3 \times 10 = 450$ pounds of force between the plates 190 for every 10 pounds of force applied on to the crank 217. Since the force between the plates will be shared between 8 line passes (considering both sides), the line will only have to withstand $\frac{1}{8}$ of the total force, requiring a relatively thin string.

The cap of the bottle 1 could have been replaced upon opening by a special cap similar to the cap 132 shown in FIG. 3, for providing a valve and spout so that the beverage could be dispensed without opening the bottle. The internal pressure can be maintained during dispensing by additional operation of the cranks 216 and 217. If the bottle's own cap is used, as shown in FIG. 7, then the pressure must be lowered to atmospheric before the bottle is opened. This can be accomplished by gently pressing down on the ratchet pawl 220 towards the plate 190, to cause it to disengage from the ratchet 219. It may be noted that, for safety reasons, the cranks 216 and 217 may be ratcheted with respect to the shafts 210 and 211, respectively, so that the cranks will not have to rotate backwards when the ratchets 218 and 219 are released. Before or after pouring the last cup of beverage, pressing the bar 220 down all the way to the plate 190, causes a protrusion 254 to engage with a pin 255 on the pawl 222, causing the latter to also disengage the ratchet 218. A latch 227 may be used to maintain both ratchets disengaged, so that the reels 212 and 213 can remain free to unwind as the plates 190 are pulled apart by hand. It may also be noted that for further safety, the pulleys 214 and reels 212 and 213 may be positioned on the inside side of the sheet metal with holes provided for the line on the sheet metal of the plates 190. Simple covers, can then be provided to cover the internal mechanism on each side.

Figure 8:
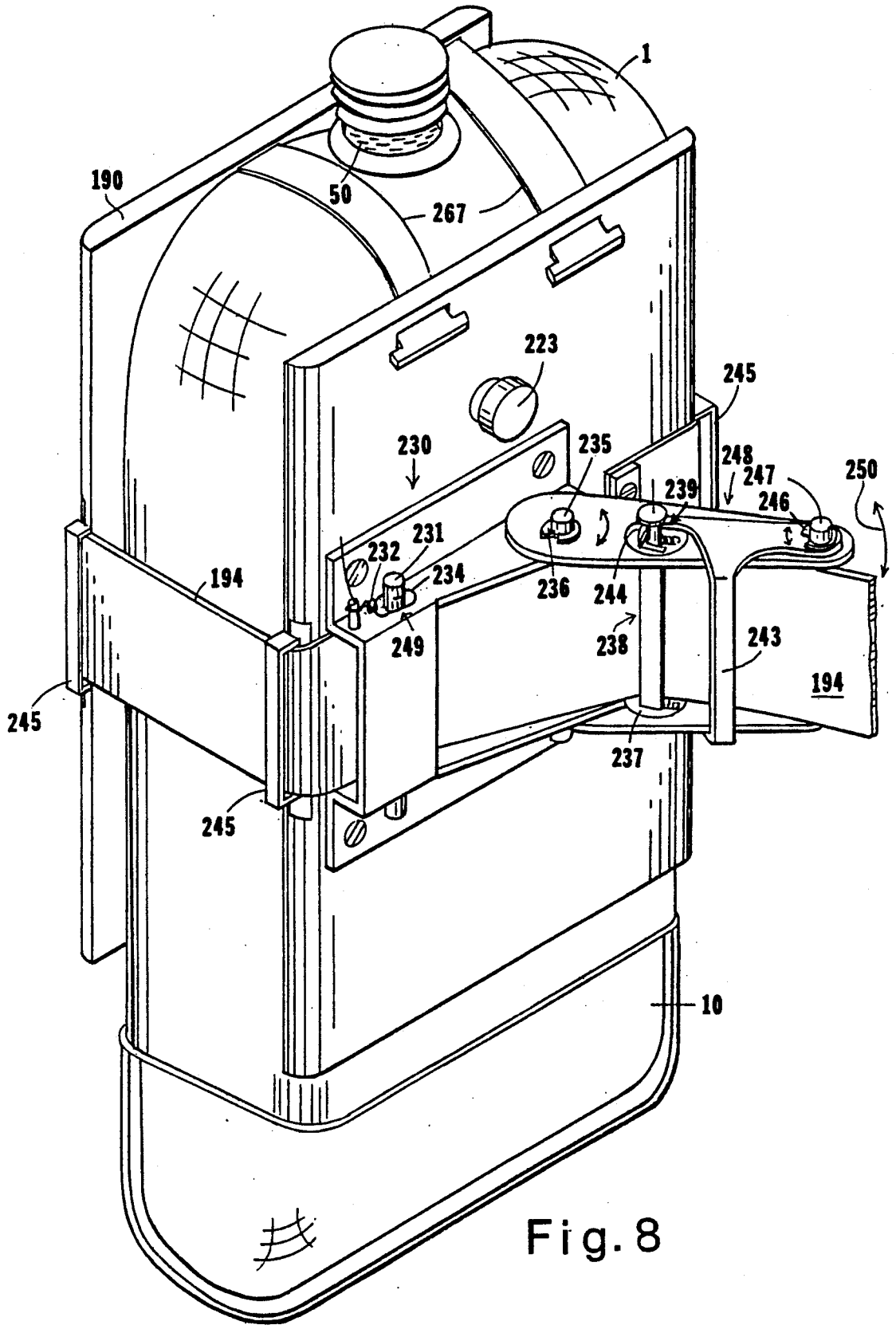
FIG. 8 is an isometric view of a third species belonging to the Embodiment C of the invention, showing two substantially flat surfaces (jaw plates) for compressing a conventional plastic bottle by hand, while the bottle remains uncovered, for bringing the level of the remaining beverage the top of the bottle, and latching means for latching the jaw plates at their final position; also showing lever means operable as mechanical advantage means for compressing the beverage secured, for further increasing the internal pressure.

The final and preferred species of a mechanism for compressing a plastic bottle is shown in FIG. 8. A bottle 1 is shown being compressed from a normally round shape to a flattened shape between two jaw plates 190. This species is characterized by the use of a strap 194, which can be tensioned around the plates 190 by jack lever means 248 and be latched by buckle means 249. The strap 194 is shown firmly attached at one end on the right side of the front plate 190. The strap has been guided around the back plate 190 through corner retainers 245, through a first latch 249, and a second latch 239. The strap is being tensioned by repeated swings of the jack lever member 248, onto which an assembly on a platform 237, comprising a pair of plates 238 at a small angle with respect to each other, forming a latch in conjunction with a cylindrical member 241. The platform 237 carrying the pair of plates 238 is rotatable in order that the narrow opening between plates 238 always points towards the latch 249. The jack lever 248 can be swung to the left by, preferably, holding on to the strap 194, in which case the length of the section of the strap between the two latches is freely pulled through the latch 239. As the jack lever 248 is then being returned to the right, the strap 194 is tentioned as the cylindrical member 241 is jammed with the strap at the narrow side of the plates 238, pulling a new section of the strap 194 through the latch 249; thereby further compressing the bottle 1. The latch 249 prevents the strap from moving backwards, as a cylinder 231 urged by a spring 232 and the strap itself, jams as the space becomes narrower due to an oblong hole 234 which is inclined with respect to the front plate 190, constraining the strap 194 from moving.

The procedure for saving the carbonation in the beverage contained in the bottle 1 is same as previously described: With the cap off or loose the bottle is compressed between the plates 190 by swinging of the jack lever assembly 248 to left and right, as shown by the arrow 250, until the level of the beverage 50 reaches the top of the bottle 1. The cap is then tightly secured and additional compression is provided by further swinging of the lever assembly 248 until the bubbles in the beverage disappear, or an indicator 223 displays a red color.

Before or after pouring the last cup of the beverage, a latch assembly 243 can keep the cylinder 241 away from the narrow region of the plates 238; thereby setting a pair of hooks 244 around the cylinder 241. Also, by keeping the cylinder 231 to the right, the plates 190 can be pulled apart for use in a next bottle.

I claim:

1. A beverage container, at least partially deformable, for preserving the $CO_2$ gas in carbonated beverages, comprising:

a beverage the carbonation of which is to be preserved;

cap means for covering said container;

a deformable portion means of said container;

force means for deforming said deformable portion means for diminishing the internal volume of said container, therefore raising the level of said beverage to near the top of said container; thereby drastically reducing the empty volume over said beverage, to which $CO_2$ gas could escape;

said force means being capable of also providing for an increase in the pressure inside said container to a desirable pressure, approximately equal to the $CO_2$ pressure in the body of said beverage, while said cap has been tightly secured on said container;

latching means for substantially maintaining the final shape of said deformable portion means during further storage of said beverage in said container; and pressure indicator means for showing when a desirable pressure has been reached inside the container by the operation of said force means.

2. A compressing and latching mechanism for preserving $CO_2$ gas in carbonated beverages comprising:

a beverage the carbonation of which is to be preserved;

a deformable plastic bottle for containing said beverage;

cap means for covering said bottle;

jaw plate means operable to hold and to compress said plastic bottle, by forces provided by the hands of a user, for diminishing the internal volume of said container, therefore raising the level of said beverage to near the top of said container; thereby drastically reducing the volume of empty space over said beverage, to which $CO_2$ gas could escape;

latching means for maintaining the final position of said jaw plate means during further storage;

mechanical advantage means for multiplying the force applied by the user's hands into a force, across said jaw plate means, sufficient for raising the pressure in said bottle, while said cap has been secured, to a pressure substantially equal to that of the $CO_2$ in said beverage; and pressure indicator means for showing when a desirable pressure is reached inside said bottle.

3. The mechanism according to claim 2, wherein said mechanical advantage means comprises line means, pulley means and reel means for engaging with said line means, and crank means; thereby the final mechanical advantage gained is the product of the ratio of crank radius to radius of said reel means and the number of pulleys used; and wherein said latching means comprises ratchet and pawl means.

4. The method for preserving carbonation in beverages comprising the steps of:

(a) enclosing the beverage into a container which is at least partially deformable and is further comprising an opening and a cover;

said cover being removable, leaving the container open; loosenable, to allow air from inside the container to escape; and tightenable, to prevent leakage of gas from inside to outside the container;

(b) after each dispensing event and with said cover removed or loose, deforming the container for decreasing its internal volume until the beverage's top surface reaches the vicinity of said opening; thereby, forcing air from inside the container to escape;

(c) with said cover tightly covering said container, further deforming said container until pressure inside the container reaches a desirable pressure level, which prevents $CO_2$ gas from evaporating from the beverage to an empty portion of the container.

* * * * *